US009630086B1

(12) United States Patent
Wahe

(10) Patent No.: US 9,630,086 B1
(45) Date of Patent: Apr. 25, 2017

(54) LEVELING DEVICE, SYSTEM AND METHOD

(71) Applicant: John M. Wahe, Golden, CO (US)

(72) Inventor: John M. Wahe, Golden, CO (US)

( * ) Notice: Subject to any disclaimer, the term of this patent is extended or adjusted under 35 U.S.C. 154(b) by 0 days.

(21) Appl. No.: 14/963,213

(22) Filed: Dec. 8, 2015

(51) Int. Cl.
*A63D 15/00* (2006.01)
*A63D 13/00* (2006.01)

(52) U.S. Cl.
CPC ..... *A63D 15/00* (2013.01)

(58) Field of Classification Search
CPC ..... A47B 9/04; A47B 91/022; A47B 91/024; A47B 91/00; A63D 15/00; F16M 7/00
USPC ..... 473/33, 12, 4, 1; 254/100, 103; 248/188.2, 188.4, 188.1; 108/147
See application file for complete search history.

(56) References Cited

U.S. PATENT DOCUMENTS 785,982 A * 3/1905 Smith ..... A47B 91/024 248/188.4
948,708 A * 2/1910 Sheppard ..... A47B 91/024 248/188.4
972,287 A * 10/1910 Swift ..... A47B 91/024 248/188.4
1,390,642 A 9/1921 Riker
1,396,259 A 11/1921 Coryell
1,417,639 A 5/1922 Sterner
1,468,034 A 9/1923 Riker
1,487,940 A 3/1924 Halsey
1,739,111 A 12/1929 Wiedemann
1,794,798 A 3/1931 Sarr
2,966,064 A 12/1960 Courtney
3,030,730 A 4/1962 Costar
3,353,777 A * 11/1967 Knoedler ..... A63D 15/00 473/16
3,653,341 A 4/1972 Nielsen
4,016,957 A 4/1977 Osujo et al.
4,065,125 A * 12/1977 Chan ..... A47B 25/00 473/14
5,071,097 A * 12/1991 Owen ..... A47B 91/00 248/188.4
5,078,249 A 1/1992 Botterill
5,092,825 A 3/1992 Goscenski, Jr. et al.
5,106,349 A 4/1992 Botterill
5,713,446 A 2/1998 Organek et al.
5,882,265 A * 3/1999 Benton ..... A63D 15/00 473/15
RE36,502 E 1/2000 Organek et al.
(Continued)

FOREIGN PATENT DOCUMENTS

CN 2355754 Y 12/1999

*Primary Examiner* — Mitra Aryanpour
(74) *Attorney, Agent, or Firm* — Colorado Patents

(57) ABSTRACT

A jack for leveling a pool table fits under at least one leg of the table. The jack has a circular base disk and a circular upper disk, with a gear wheel disposed between the disks. Opposing surfaces on the disks and the gear wheel have pairs of cooperating circular ramped grooves therein, with each pair of grooves receiving a ball. A worm gear has teeth in geared connection with the teeth of the gear wheel. Turning the worm gear causes the gear wheel to rotate, which causes the balls to roll in their respective pair of grooves, thus creating an axial motion of the gear wheel and upper disk. By selectively turning the worm gear in a clockwise or counter-clockwise direction, the axial motion may be used to selectively raise or lower the pool table, in order to level the playing surface.

20 Claims, 9 Drawing Sheets

(56) References Cited

U.S. PATENT DOCUMENTS

| | | | | |
|---|---|---|---|---|
| 6,095,463 | A * | 8/2000 | McCormick | A63D 15/00 248/188.2 |
| 6,102,808 | A * | 8/2000 | Wong | A47B 9/04 473/11 |
| 6,637,569 | B1 | 10/2003 | Organek et al. | |
| 6,729,590 | B2 | 5/2004 | Gabriel | |
| 7,010,996 | B2 | 3/2006 | Schick et al. | |
| 7,252,017 | B2 | 8/2007 | Kramer | |
| 7,654,911 | B2 | 2/2010 | Cartwright | |
| 7,735,612 | B2 | 6/2010 | Pozivilko et al. | |
| 7,828,668 | B1 * | 11/2010 | Tippit | A63D 15/00 473/10 |
| 7,878,543 | B2 | 2/2011 | Bodtker et al. | |
| 8,141,568 | B2 | 3/2012 | Huntington et al. | |
| 8,550,929 | B1 * | 10/2013 | Nebauer-McRae | A63D 15/00 473/1 |
| 8,662,260 | B2 | 3/2014 | Baldeosingh et al. | |
| 2006/0196302 | A1 | 9/2006 | Hochmuth et al. | |
| 2008/0156235 | A1 * | 7/2008 | Keirstead | A47B 13/003 108/146 |
| 2009/0173366 | A1 | 7/2009 | Huntington et al. | |
| 2009/0270191 | A1 * | 10/2009 | Cartwright | A63D 15/00 473/33 |

* cited by examiner

LEVELING DEVICE, SYSTEM AND METHOD

TECHNICAL FIELD

This invention relates to a device for leveling large objects. More particularly, the invention is a jack which is retrofittable to existing pool tables, and utilizes three disks having ramps of varying depth in which two sets of balls travel, thereby selectively creating an axial lifting or lowering action to level the pool table.

BACKGROUND ART

It is quite common for the playing surface of a pool table to require leveling. This need can arise because the floor on which the table sits is not level, or because the table itself is not level, or both. Numerous attempts have been made to provide solutions to this leveling problem.

Perhaps the most common and well-known solution is leveling the table by placing shims under the feet of one or more of the table's support legs. The shims may often simply be folded pieces of paper, match book covers, or even slivers of wood. Some shims are even sold at retail, with hard rubber disks being popular, for example. As leveling solutions, shims are simple and somewhat effective, but are generally lacking in durability and ease of use.

Another simple solution is through the use of a leveling foot, a device which is often used on chairs, tables, and other furniture to extend their legs. The leveling foot includes a threaded shaft having a larger diameter circular foot on its lower end, and with its upper end extending into a threaded sleeve in the leg of a table, for example. By turning the foot in the desired direction, the shaft may be caused to extend from or retreat into the leg. In this way, the leg may be made effectively longer or shorter, thereby raising or lowering the table as desired. While this is an effective approach for some furniture, it is less effective for pool tables. For one thing, it requires that the leveling foot be un-weighted while the foot of the device is rotated. This works best with lighter furniture such as chairs or light tables. However, pool tables often weigh several hundred to a thousand pounds or more, which would make un-weighting the leveling foot awkward at best. In addition, a leveling foot would be quite difficult for the average user to retrofit to a pool table, further limiting its usefulness.

A basic leveling foot arrangement is depicted in U.S. Pat. No. 7,654,911 B2 to Cartwright. Cartwright uses an internally-threaded insert 24, which includes a threaded metal sleeve with a flange 25 at one end. A hole must be drilled in the bottom of the table leg to allow the insert to be placed in the leg. This allows the rod 22 of leveling foot 26 to be inserted into sleeve 30, with the entire combination being fitted into the furniture leg 14. Knob 28 is provided to allow the leveling foot to be operated while the device is still weighted. However, the knob of Cartwright is better suited for use with lighter furniture, as turning the knob while supporting the large weight of a pool table would be difficult.

A variation of the leveling foot approach is shown in U.S. Pat. No. 6,729,590 B2 to Gabriel. The device of Gabriel is designed such that it could be operated while still supporting the weight of a pool table. This capability is accomplished by providing a worm gear for driving a driven gear, which in turn drives an elevation shaft to raise or lower an object. However, operating the Gabriel device while still supporting the weight of a heavy pool table would cause large amounts of friction between the threads of the worm gear and those of the driven gear. This degree of friction would require a relatively large amount of force to overcome, and would also necessitate that the device be constructed of steel or other hard metal.

Other variations of the leveling foot approach are disclosed in U.S. Pat. No. 1,417,639 to Sterner; and U.S. Pat. No. 3,653,341 to Nielsen. Each of those devices provides a way to drive the leveling foot while still supporting the weight of the table. However, all of the leveling foot devices suffer from friction problems similar to those found with Gabriel. In addition, none of the devices, including Gabriel, are suitable for retrofitting to an existing pool table having no leveling capabilities. Therefore, the devices must be included in the legs of a table when it is sold, which may be seen as an unnecessary added expense by potential buyers of the table. In addition, home pool table legs are often thin at the bottom, making them further unsuited for enclosing a leveling foot device.

The friction problems associated with the Gabriel, Sterner, Nielsen, and Cartwright devices could be overcome by utilizing an arrangement of balls or rollers traveling in lifting ramps or grooves between two surfaces as may be seen in U.S. Pat. No. 7,878,543 B2 to Bodtker et al.; U.S. Pat. No. 7,252,017 to Kramer; and U.S. Pat. No. 5,106,349 to Botterill et al. In each of the foregoing patents, two opposing plates or disks have lifting ramps in which balls travel when one of the plates is rotated. As the balls rise or sink on the lifting ramps, an axial motion is created, which may be used to raise or lower a supported object such as a pool table.

However, in order to raise or lower a pool table, at least three plates would be required. This is due to the fact that the upper and lower plates would necessarily be non-rotatable while the device was bearing the weight of the table. Yet the aforementioned patents disclose devices with only two plates having opposing grooves in which balls would travel. Therefore, it is necessary to provide some means for handling the friction between the surfaces of the two plates having no opposing grooves between them. One way to handle this friction is disclosed in U.S. Pat. No. 8,662,260 B2 to Baldeosingh et al., which uses a thrust bearing to reduce friction. U.S. Pat. No. 4,016,957 to Osujo et al. uses Teflon for a wear surface, while U.S. Pat. No. 7,735,612 Pozivilko et al. uses a Boss washer and a retaining washer as a bearing surface.

While all of these solutions are effective in handling friction between plates, they each require additional parts or material which does not contribute directly to the lifting function of the device. In addition, having two plate surfaces with no grooves therein makes the device unnecessarily thicker, for a given amount of lift. This is counter-productive, since it is of critical importance that the height of the device be kept as low as possible, while still producing sufficient lift. A low height is necessary for any device which is to be retrofitted to the foot of an existing pool table leg, as the overall height of the pool table cannot be excessively increased without changing the look and feel of the game to the players, which would make the device unacceptable. It is thus critical for a retrofittable leveling device to seek the most lift with the least height possible. This is especially true since the weight of a pool table may exceed a thousand pounds.

Some of the foregoing problems are alleviated by U.S. Pat. No. 5,713,446 to Organek et al; and U.S. Pat. No. 5,078,249 to Botterill. The devices of Organek and Botterill provide three plates, with 2 sets of balls traveling in two sets of opposing grooves. In this configuration, the friction between the second set of opposing surfaces is handled by the second set of balls themselves, without the need for additional parts merely to handle the friction. The second set of balls also provides a lifting action, thereby making more effective use of the height of the device to produce lift.

However, the configuration of Organek and Botterill results in essentially maximizing the required thickness of the control plate, and thereby unnecessarily increases the overall height of the device for any given lift provided. This unwanted result occurs because both devices "stack" the grooves on the upper surface of the control plate directly over the grooves on the lower surface of the control plate, bunk bed style. In particular, the deep end of each lower groove is directly underneath the deep end of a respective upper groove. This means that the thickness of the control plate must be equal to twice the deepest depth of a groove, plus a minimum material thickness between two grooves. This would not work well for a retrofittable leveling device for a pool table, to be placed under one or more legs of the table. Such a retrofittable device would necessarily be capable of generating the required lift, without being so thick as to disturb the look and feel of the game by adding excessive height to the playing surface of the table.

There is thus a need for a leveling device which is capable of producing sufficient force to raise and lower a pool table of substantial weight. The device would be retrofittable to an existing pool table, without a need for the owner to perform complex tasks, such as drilling a hole in a pool table leg in order to insert components of the device. The use of the leveling device should also not disturb the aesthetics of the table itself. When installed under a leg of the table, the thickness of the device would ideally add as little to the height of the table as possible, while still maintaining the capability to raise and lower the table easily.

SUMMARY OF THE INVENTION

In accordance with the invention, a jack for leveling a pool table is provided. The jack includes a circular base disk having an upper surface, a circular upper disk having a lower surface, and a circular gear wheel disposed between the disks and having a center hole preferably a circular center hole. The gear wheel has a lower surface opposing the base disk upper surface to form a first pair of opposing surfaces, and an upper surface opposing the upper disk lower surface to form a second pair of opposing surfaces. The gear wheel further includes gear teeth on its circumference, in geared connection with a worm gear. A hub projects from a first disk of the disks and extends through the center hole of the gear wheel. The gear wheel is rotatably mounted to the hub, and is capable of axial motion thereon. A hub engagement member is mounted to the second disk of the disks for engaging the hub to lock the disks rotationally in relation to each other. The upper surface of the base disk has a plurality of grooves, with the grooves following a circular arc along the longitudinal centerline of the base disk grooves, and having a radius extending from the center of the base disk upper surface to the centerline.

The lower surface of the gear wheel has a plurality of grooves, including one groove for each of the base disk grooves, with the lower gear wheel surface grooves following a circular arc along the longitudinal centerline of the gear wheel lower surface grooves, and having a radius extending from the center of the gear wheel lower surface to the centerline, with the radius being equal to the radius of the base disk upper surface grooves. A plurality of grooves are provided in the upper surface of the gear wheel, with the grooves following a circular arc along the longitudinal centerline of the gear wheel upper surface grooves, and having a radius extending from the center of the gear wheel upper surface to the centerline.

The lower surface of the upper disk has a plurality of grooves, including one groove for each of the upper gear wheel surface grooves, with the upper disk grooves following a circular arc along the longitudinal centerline of the upper disk grooves, and having a radius extending from the center of the lower surface of the upper disk to the centerline, and with the radius being equal to the radius of the gear wheel upper surface grooves.

Each of the grooves has a deep end and a shallow end, and a ramp extending between those ends, and the radius of the gear wheel lower surface grooves and the radius of the gear wheel upper surface grooves are unequal. Each of the grooves cooperates with a groove from its opposing surface to form an opposing pair of grooves.

There is a ball disposed in each pair of opposing grooves for rolling movement therein. A worm gear is provided and has threads in geared connection with the teeth of the gear wheel, so that rotating the worm gear in a selected clockwise or counterclockwise direction causes the gear wheel to rotate in a corresponding selected direction. This in turn causes each ball to roll in its groove and axially move the first and second opposing surfaces either towards each other or away from each other, thereby enabling an axial lowering or lifting movement of the jack.

Optionally, a central retaining bolt may be mounted at a proximal end to the base disk, with the retaining bolt having a head at a distal end. A central retaining bolt sleeve extends through the gear wheel and the upper disk. The retaining bolt sleeve has flanges which abut with the head to prevent further axial lifting movement when the lifting movement reaches a preselected maximum.

In view of the foregoing, several advantages of the present invention are readily apparent. A jack is provided which is capable of producing sufficient force to raise a heavy pool table. The device is retrofittable to an existing pool table, without a need for the owner to perform complex tasks, such as drilling a hole in a pool table leg in order to insert components of the device. The use of the jack also does not disturb the aesthetics of the table itself. When installed under a leg of the table, the thickness of the device adds as little to the height of the table as possible, while still maintaining the capability to raise and lower the table easily.

Additional advantages of this invention will become apparent from the description which follows, taken in conjunction with the accompanying drawings.

DETAILED DESCRIPTION OF THE PREFERRED EMBODIMENT

Figure 1:
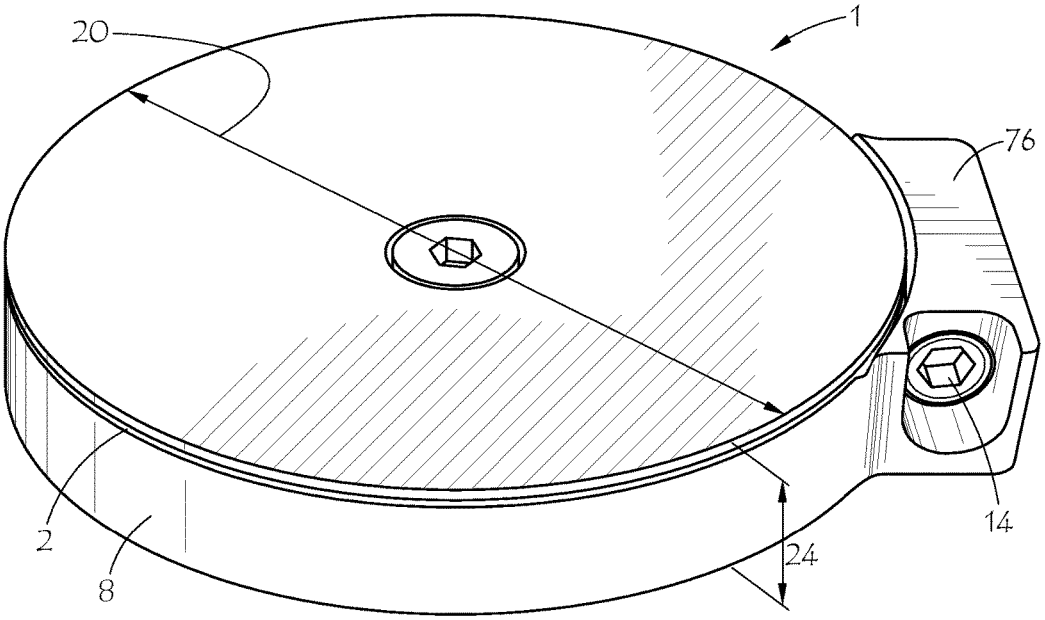
FIG. 1 is a perspective view of the leveling device in the closed position.
Figure 2:
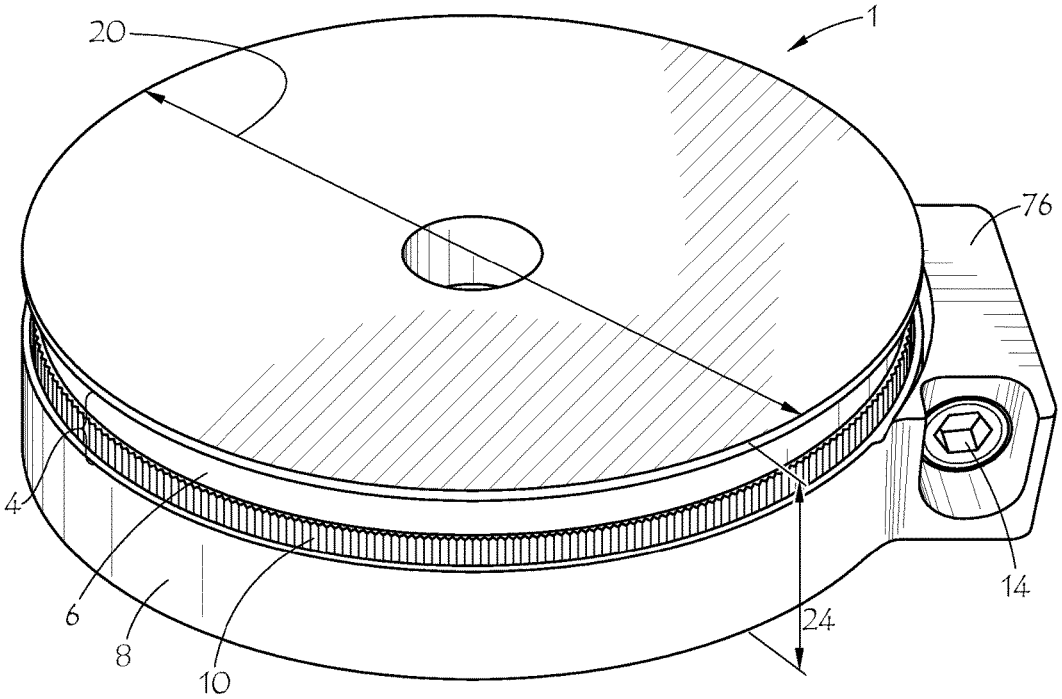
FIG. 2 is a perspective view of the device in the open position.
Figure 3:
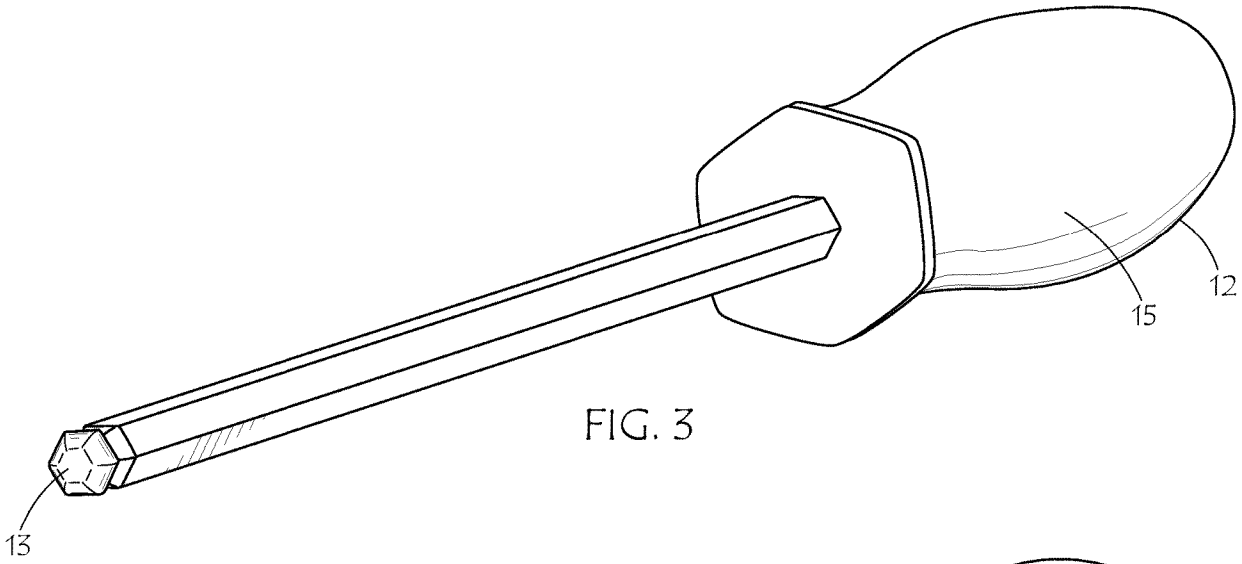
FIG. 3 is a perspective view of the hand tool for turning the worm gear.
Figure 4:
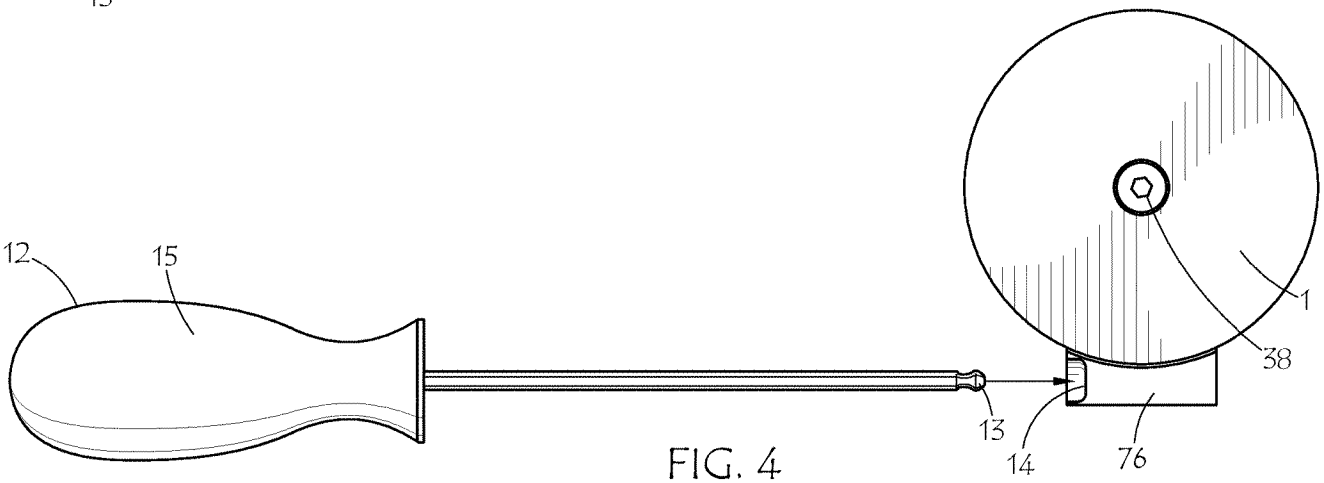
FIG. 4 is a top view showing the hand tool of FIG. 4, and the insertion of the tool into the device.

Referring now to FIGS. 1 and 2, a leveling jack 1 according to the present invention is depicted. FIG. 1 shows the device 1 in the closed position 2, while FIG. 2 shows the device 1 in the fully open position 4. In the fully open position 4, the upper portion 6 of the device is separated from the base portion 8 by a gap 10. The gap 10 is equal to the lift provided by the device 1 in its open position 4. As shown in FIGS. 3 and 4, the device 1 is activated by a hand tool 12, by inserting the tip 13 of the tool into the tip receptacle 14 and turning the handle 15 of the tool. As shown, the tip 13 is in the form of a hex ball driver, rather than a more traditional Allen wrench, for example. This hex ball driver shape allows the tool 12 to be inserted at an oblique angle to the floor, thereby providing greater clearance for the operator's hand in operating the tool.

Figure 5:
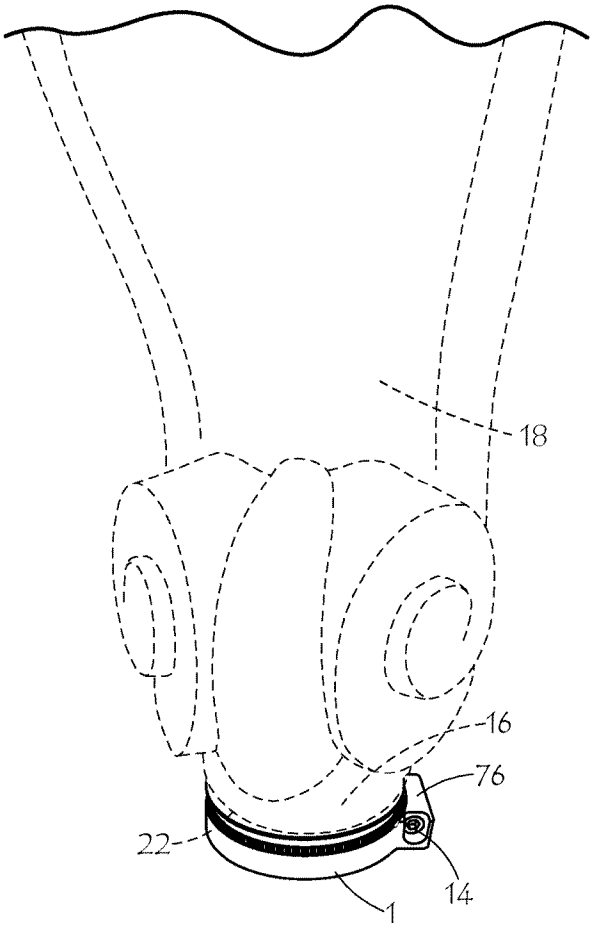
FIG. 5 is a perspective view of the device in place under the foot of a pool table leg.

Turning now to FIG. 5, the device 1 is shown in place under the foot 16 of a pool table leg 18. It will be noted that the device 1 has approximately the same diameter 20 as the diameter 22 of the pool table foot 16. This is an important consideration for the aesthetics of using the device 1 under the foot of a pool table leg. Pool tables which merit the use and expense of a precise leveling device such as the present invention, typically with one device under each of the table's four corner legs, are often themselves expensive and visually striking pieces of furniture. Therefore, it is desirable that the device 1 be as unobtrusive as possible, so as not to disturb the aesthetics of the pool table.

Experience and aesthetic sense dictate that the most visually pleasing and unobtrusive diameter 20 for the device 1 is a diameter which matches the diameter 22 of the foot 16. Achieving this aesthetic match between the respective diameters of the foot 16 and the device 1 is made considerably easier by the fact that a de facto industry standard diameter of three inches has been adopted for the feet of most home pool table legs. Therefore, the device 1 is typically manufactured with a diameter 20 of three inches, or very close to that diameter. As will be readily appreciated, such a size constraint complicates the design of any device to be used to precisely lift pool tables, which can sometimes weigh well over a thousand pounds. Of course, a larger device could much more easily be utilized to lift such a heavy object, but the constraints on the maximum diameter of the device do not always allow that option.

In addition to the foregoing aesthetic constraints on the diameter 20 of the device 1, there are also practical and physical limits placed on the height 24 of the device. Of course, the overall height 24 of the device 1 will vary at any given time, depending upon how much lift is being provided by the device at the moment. Physically, the maximum height 24 must not be so great as to cause the pool table to wobble. On a more practical level, in operation the height 24 of the device 1 must not cause such an increase in the overall height of the pool table so as to be unacceptable to the players using the table.

One reason for the practical limits on the height of the device is that it may reasonably be anticipated that many users of the device will be "serious" players, since less serious players would most likely not invest in a set (typically four to a set) of devices designed to level their table to a precise degree. Such serious players would not want to have the feel of their game disrupted by an excessive change in the height of the table's playing surface. As an example, the height 24 of the preferred embodiment of the device 1 is one-half inch in the closed position 2, and seven-eighths of an inch in the fully open position 4. As was the case with the small diameter 20, the critical limitations on the maximum height 24 of the device 1 thus greatly complicate the problem of achieving large amounts of lift from a device with such size limitations.

Referring now to FIGS. 6 through 9, the main internal working parts of the device 1 are shown. A base disk 30 and an upper disk 31 have a gear wheel 32 between them. Optional non-slip covers 34, 35 are preferably provided to aid in preventing slipping of the device 1 on the floor, and also to prevent slipping of the pool table foot 16 on the device 1. The covers 34, 35 are preferably made of rubber or other resilient non-slip material, and are mounted to the base disk 30 and the upper disk 31 respectively. Gear wheel 32 has a circular center hole 37 which receives hub 36, thus allowing the gear wheel 32 to rotate freely around the hub 36, as well as to move axially up and down thereon. Preferably, the hub 36 is mounted to the base disk 30, although it could optionally be mounted to the upper disk 31. Advantageously, a tight tolerance is maintained between the hub 36 and the center hole 37, so as to eliminate wobbling in the device 1, and to facilitate the alignment of the worm gear threads 72 with the gear wheel teeth 74. Spline sleeve 38 is mounted opposite the hub 36, either to upper disk 31 when the hub is mounted to the base disk 30, or to base disk 30 if the hub were to be optionally mounted to the upper disk 31. Spline sleeve 38 has male splines 39 which fit into hub slots 40, to rotationally lock the base disk 30 and the upper disk 31 in place relative to one another. In this way, the gear wheel 32 may rotate freely, while the base disk 30 and upper disk 31 remain rotationally fixed.

Figure 6:
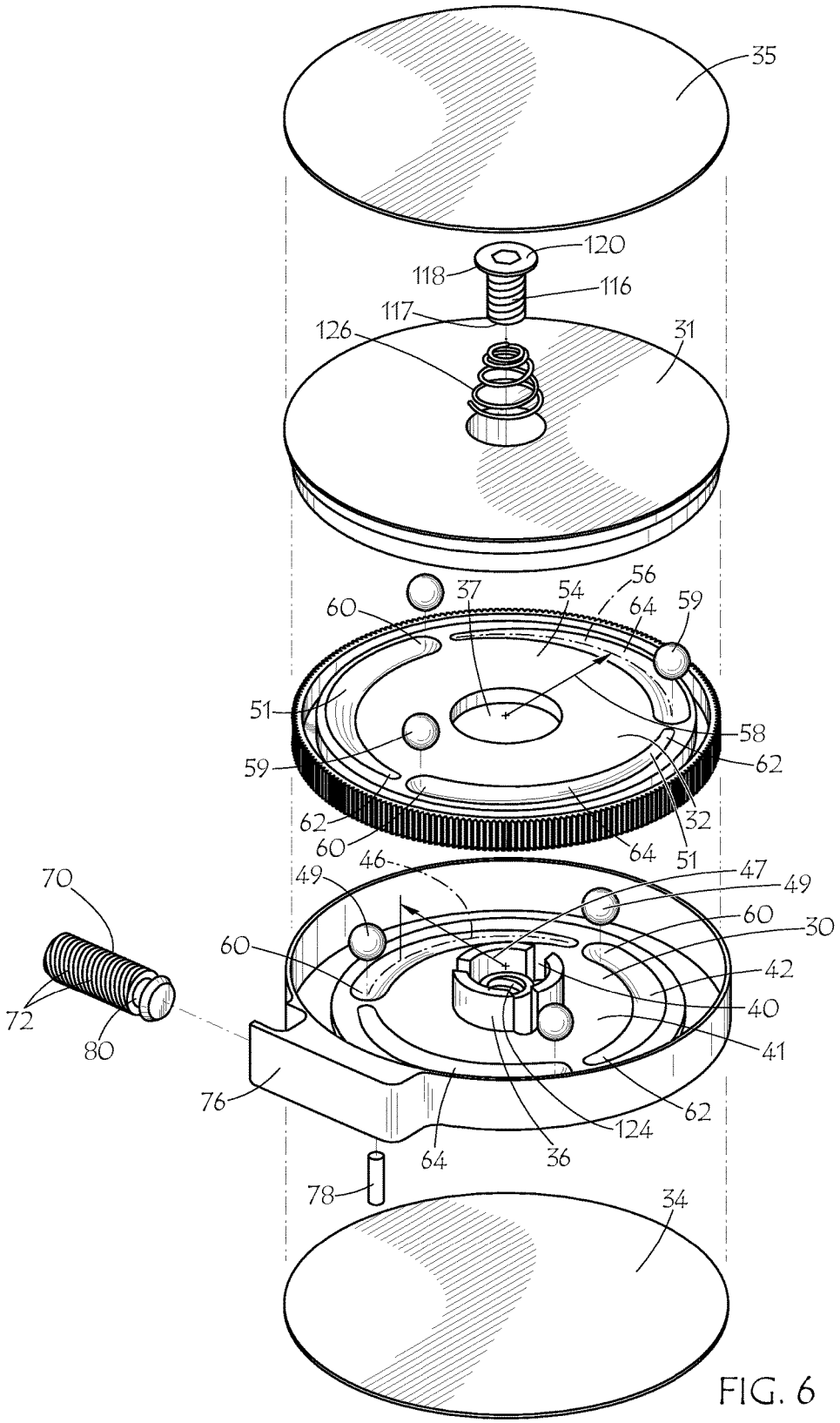
FIG. 6 is an exploded view of the device, showing the upper surfaces of the gear wheel and the disks, and associated parts of the device.
Figure 7:
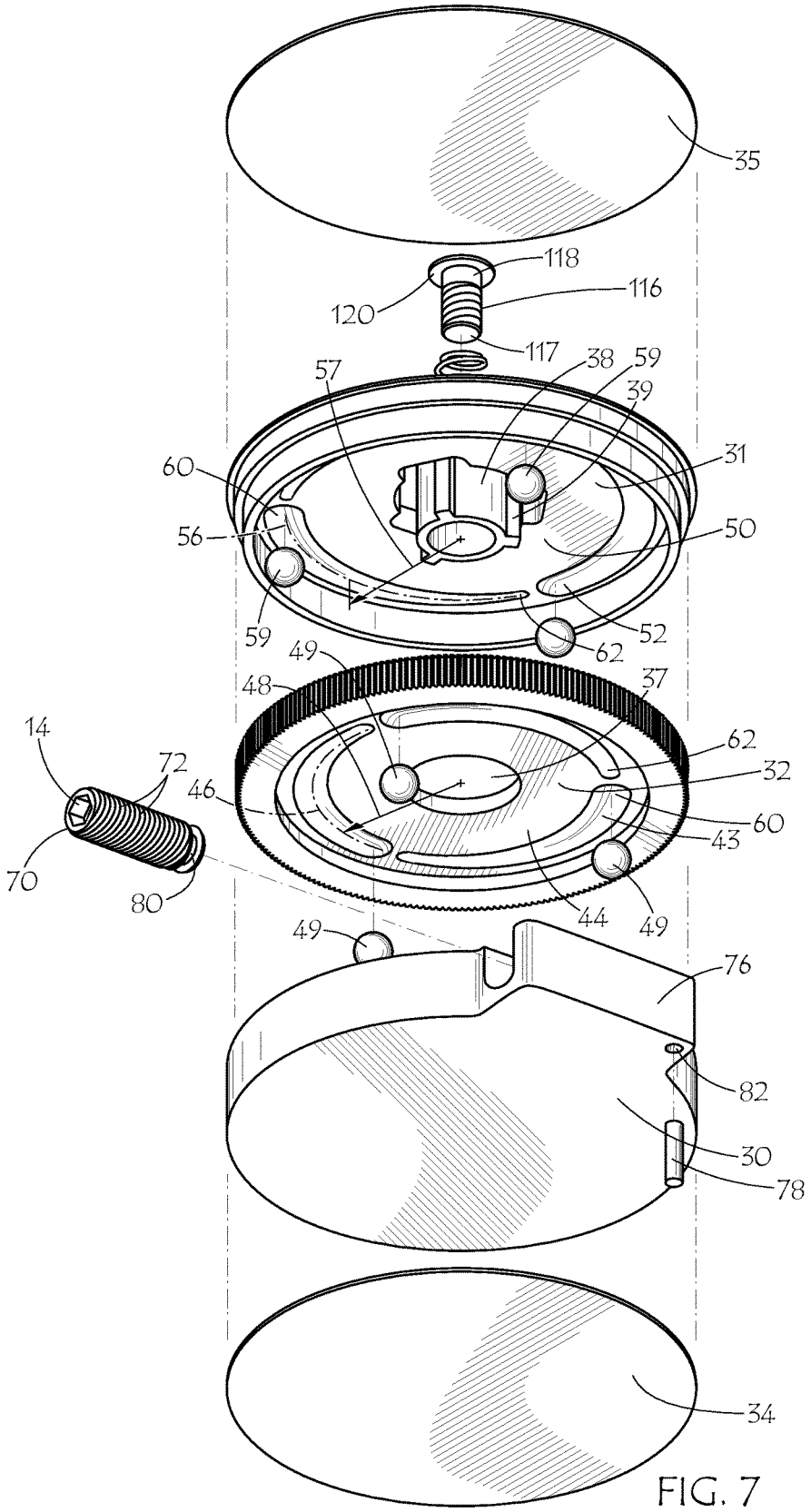
FIG. 7 is an exploded view of the device, showing the lower surfaces of the gear wheel and the disks, and associated parts of the device.

As best seen in FIGS. 6 and 7, in the preferred embodiment the upper surface 41 of base disk 30 includes a series of three grooves 42, each of which is paired with an associated groove 43 on the lower surface 44 of gear wheel 32. The centerline 46 of each of the grooves 42, 43 is a circular arc which is concentric with the circular shape of the respective disk or gear wheel on which the groove 42, 43 resides. Each base groove 42 has a radius 47 equal to the radius 48 of its respective opposing groove 43. A set of three balls 49 is provided, with one ball 49 rolling within each pair of opposing grooves 42, 43 when the device is activated, as will be described.

In like fashion, opposing grooves 51, 52 are also provided on the upper surface 54 of gear wheel 32, and on lower surface 50 of upper disk 31. These grooves 51, 52 also each follow a circular arc 56, and have respective radii 57, 58 which are equal to each other. A set of three balls 59 is provided, with one ball 59 rolling within each pair of opposing grooves 51, 52 when the device is activated. It should be noted that while a set of three grooves 42, 43, 51, 52 have been provided on each level, sets of two, four, or any number of grooves might be utilized. The use of three grooves has been found to provide an optimal combination of leverage and stability, and is thus the preferred number of grooves for the device 1.

Figure 8:
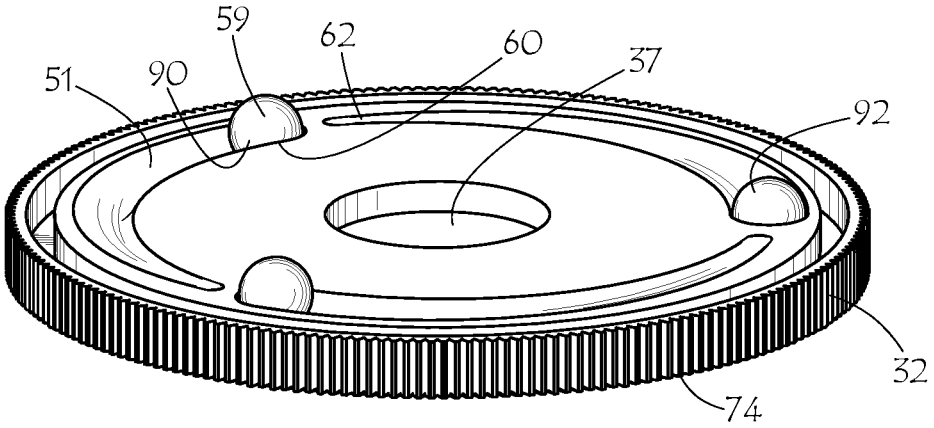
FIG. 8 is a perspective view of the upper surface of the gear wheel, with the balls in the deep end of their respective grooves.
Figure 9:
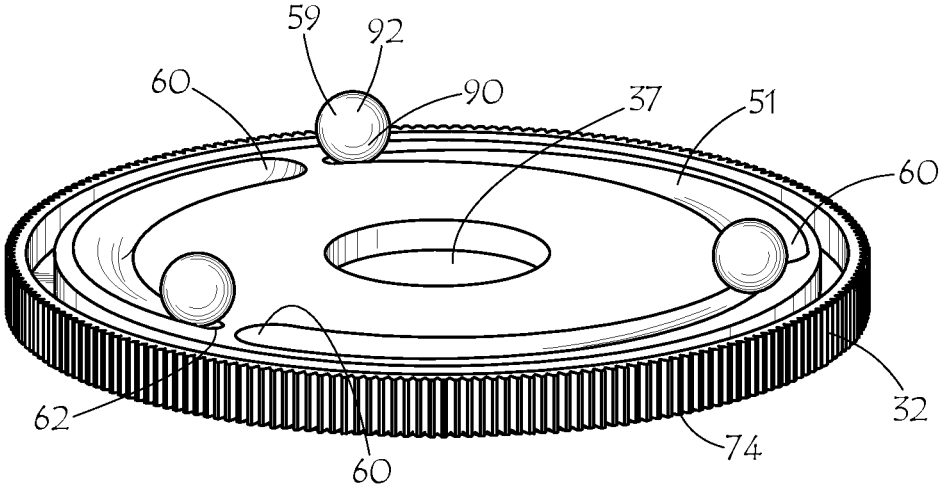
FIG. 9 is a perspective view of the upper surface of the gear wheel, with the balls in the shallow end of their respective grooves.

Each groove 42, 43, 51, 52 has a deep end 60 and a shallow end 62, with a continuous inclined ramp 64 extending between those ends. As illustrated in FIGS. 8 and 9, each of the balls 59 begin in their respective deep end 60 when the device 1 is in the closed position 2, and travel toward the shallow end 62 as the lifting action of the device 1 is activated, reaching the shallow end 62 when the device 1 is in the fully opened position 4. This travel from deep end 60 to shallow end 62 also occurs in the same way with respect to balls 49. For stability purposes, the shallow end 62 maintains a minimum depth, so that the balls 49, 59 are at all times restrained within their respective groove. For example, for balls of one-quarter inch diameter, a shallow end depth of one thirty-second inch has been found to be effective in optimizing lift, while at the same time providing sufficient depth so that the balls do not slide outside of their respective grooves.

Worm gear 70 is provided, and includes threads 72 for interacting with the teeth 74 of the gear wheel 32. As may also be seen in FIGS. 10 and 11, the worm gear 70 fits into cylindrical casing 76, in close proximity to the gear wheel 32. The worm gear 70 is restrained from moving axially in the casing 76 by stop pin 78, which slides into groove 80 on the side of worm gear 70. The stop pin 78 in turn fits snugly into stop pin hole 82 in the casing 76, and is thereby held in place. This arrangement between the stop pin 78 and the worm gear 70 allows the worm gear to rotate freely in the casing 76, while the stop pin provides a low-friction bearing surface to prevent the worm gear from moving axially in of the casing 76 as the worm gear rotates. In addition, the casing 76 prevents lateral movement of the worm gear 70 as it rotates. By thus preventing both linear and lateral motion of the worm gear 70, this configuration acts to maintain the synchronous relationship between the worm gear threads 72 and the gear wheel teeth 74.

Figure 11:
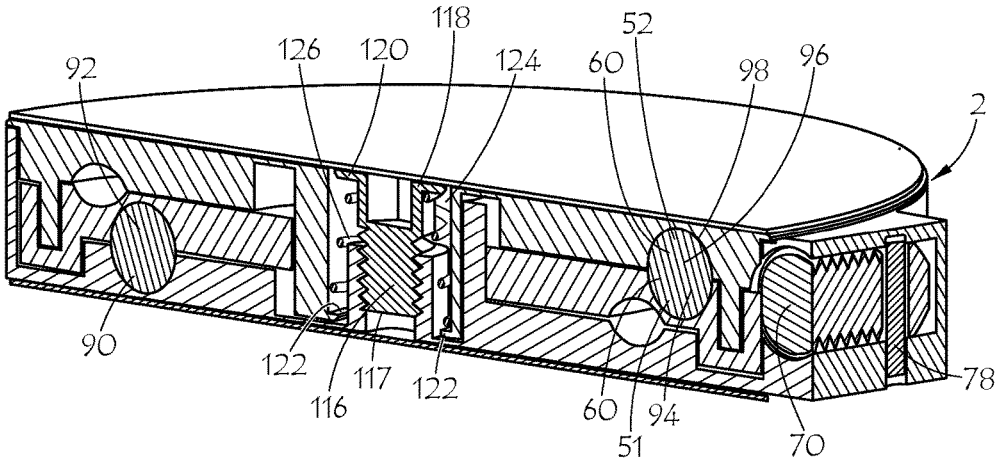
FIG. 11 is a cross-sectional view of the device in the closed position.

In a lifting operation, beginning in the closed position 4, each ball 49, 59 is in the deep end 60 of its respective groove 42, 43, 51, 52. This may best be seen in FIG. 8, where each spherical ball 59 has its lower hemispherical half 90 entirely contained in its respective groove 51, while the hemispherical upper half 92 extends out of the groove 51. In this position, the upper half 92 of each ball 59 will be entirely contained in the deep end 60 of groove 52 in the upper disk 31. As may be seen in FIG. 11, showing the device in the closed position 2, each of the deep ends 60 of the upper grooves 51, 52 has a semi-circular cross-section 94, 96, which is exactly adapted to contain its respective hemispherical half 90, 92 of ball 59. Thus, when the device 1 is closed as in FIG. 11, the two semi-circular cross sections 94, 96 combine to produce one perfectly circular cross-section 98, which is exactly sized and shaped for containing an entire spherical ball 59.

To activate the lifting operation of the device 1, the worm gear 70 is turned in a clockwise direction, using the hand tool 12. A single clockwise turn of the worm gear 70 moves the gear wheel 32 one tooth 74 in a clockwise direction. In the preferred embodiment as shown in FIGS. 8 and 9, the gear wheel 32 has 172 teeth, resulting in a great deal of leverage. Referring to the upper set of balls 59 in FIGS. 8 and 9, as the gear wheel 32 turns, the upper set of balls 59 move from their deep end 60 to shallow end 62 in the grooves 51, 52. As the balls move from the deep end 60 to shallow end 62, upper disk 31 is forced to move axially away from the gear wheel 32. At the same time, in response to the same gear wheel rotation the lower set of balls 49 move in like fashion from deep to shallow in their opposing grooves 42, 43, additionally forcing the base disk 30 and the gear wheel 32 axially apart. This separation of the opposing surfaces 41, 44, 50, 54 provides an axial lifting movement of the opposing surfaces 41, 44, 50, 54, thereby moving the pool table leg upward to aid in leveling the table. A lowering motion of the opposing surfaces 41, 44, 50, 54 may be produced by selectively rotating the worm gear 70 in the opposite direction, thereby moving opposing surfaces axially closer to one another and lowering the height of the pool table.

An examination of some actual dimensions will be instructive in gaining perspective on the above-described operation of the device 1. In one instance of the preferred embodiment, the balls 49, 59 are one-quarter inch in diameter. Therefore, in order to accept exactly one-half of the ball in the closed position 2, the deep end 60 of each groove 42, 43, 51, 52 must be one-eighth inch deep. As discussed earlier, with balls 49, 59 of one-quarter inch diameter, a shallow end 62 having a depth of one thirty-second of an inch may optionally be utilized.

Beginning in the closed position 2, the balls 49, 59 move from the deep end 60 toward the shallow end 62, in response to the turning of the gear wheel 32. As previously noted, each clockwise turn of the worm gear 70 turns the gear wheel 32 one tooth in the same direction. Thus, with the foregoing configuration and with a gear wheel 32 having 172 teeth, for each turn of the worm gear 70 the device 1 will provide approximately 0.004 inches of lift, which is approximately the thickness of an ordinary piece of printer paper. This amount of lift per turn of the worm gear is of interest for comparison purposes, as it is common for pool table owners to use pieces of paper as shims to provide a makeshift way of leveling their pool table surfaces.

For the same configuration as just discussed, the device 1 will provide a maximum lift of three eighths of an inch in moving from a closed position 2 to a completely open position 4. This maximum lift may be calculated, starting from the fact that the balls 49, 59 move from the deep end 60 to the shallow end 62 in each of four sets of grooves 42, 43, 51, 52. Thus, in each groove 42, 43, 51, 52, the ball 49, 59 moves from a depth of one eighth inch in the deep end 60, to a depth of one thirty-second of an inch in the shallow end 62, an axial movement of three thirty-seconds of an inch. Thus, each set of grooves 42, 43, 51, 52 provides three thirty-seconds of an inch of lift as the device 1 moves from closed to fully open. Since there are four sets of grooves 42, 43, 51, 52 in the device 1, the total lift provided is four times as great as three thirty-seconds of an inch, or three eighths of an inch.

As previously discussed, one of the main problems confronting the device 1 of the present invention is creating large amounts of leverage for very precise lifting, while still adhering to severe constraints on the device's diameter 20 and height 24. In that context, positioning of the grooves 43, 51 on the gear wheel 32 can have a significant impact. For instance, the grooves 43, 51 of the gear wheel 32 could have equal radii 48, 58, and be "stacked," with one directly on top of the other in the gear wheel, bunk-bed style. That configuration would allow the largest possible radii 48, 58, for a device 1 of a particular diameter 20. With grooves 43, 51 thus having maximized and equal radii 48, 58, the grooves could be made as long as possible for that particular diameter 20, thus maximizing their leverage. However, maximizing the available leverage of the grooves in this way comes with one significant disadvantage. Having the deep ends 60 of the grooves 43, 51 stacked one on top of the other in that fashion would require a gear wheel 32 which was nearly twice as thick as a gear wheel having only one set of grooves. This would significantly add to the overall height 24 of the device 1 which can be undesirable.

Figure 14:
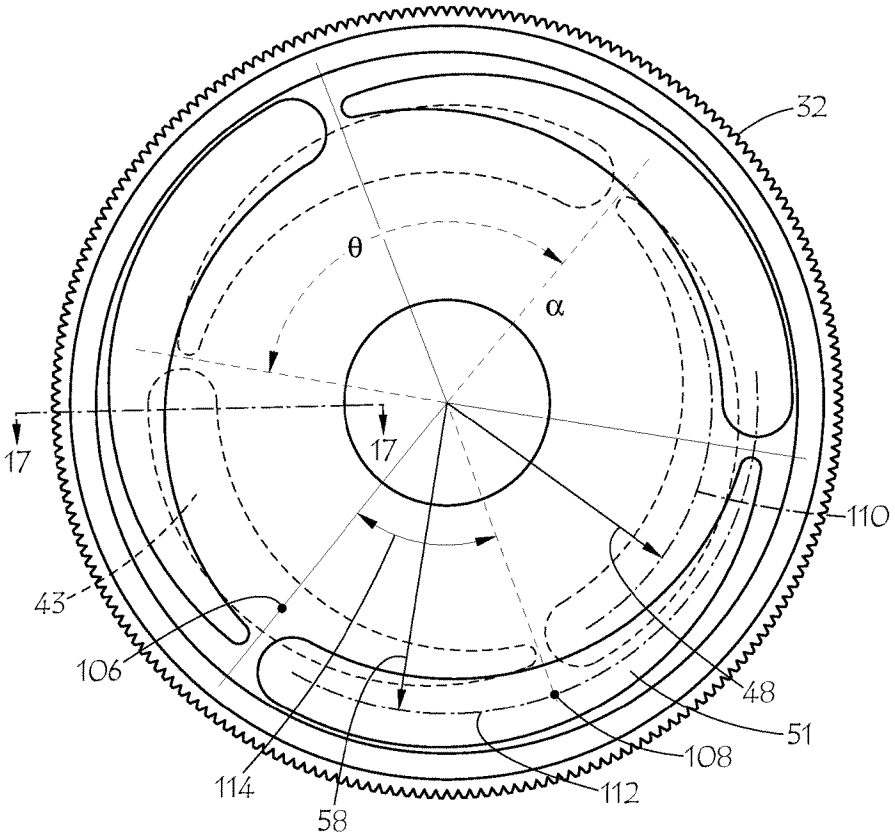
FIG. 14 is a top transparent view of the gear wheel, showing the upper and lower grooves offset from one another, and with the upper grooves overlapping the lower grooves.
Figure 12:
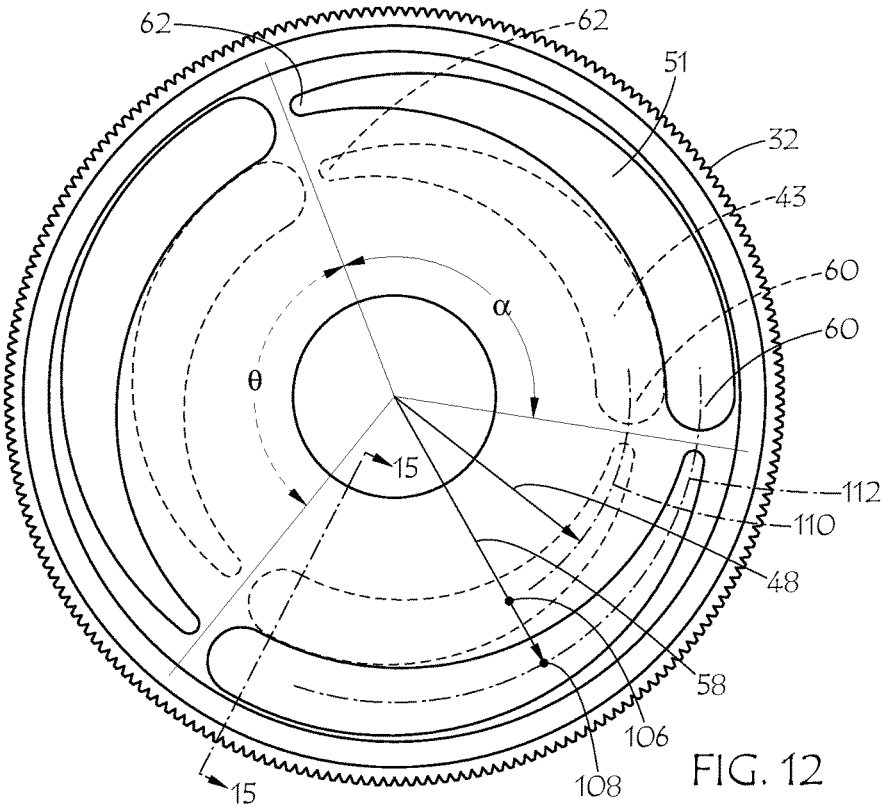
FIG. 12 is a top transparent view of the gear wheel, showing the upper and lower grooves directly adjacent to one another.
Figure 15:
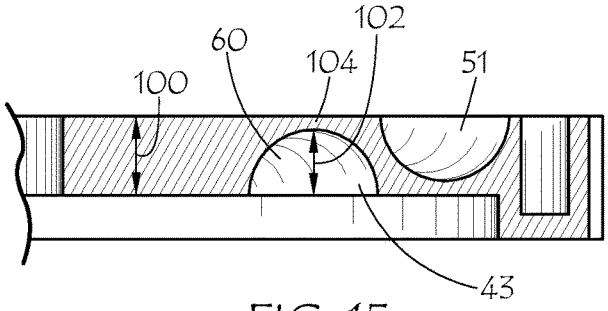
FIG. 15 is a cross-sectional view of the gear wheel shown in FIG. 12.

Referring now to FIGS. 12-17, three alternative solutions are presented to the foregoing problem of configuring the gear wheel grooves 43, 51 so as to optimize the radii 48, 58 and the height 24, while remaining within the size constraints placed on the device 1. In one solution, as seen in FIGS. 12 and 15, the grooves 43, 51 may be placed side-by-side in the gear wheel 32. This configuration has the advantage of minimizing the required thickness 100 of the gear wheel 32. In this configuration, the gear wheel 32 must only be thick enough to accommodate the depth 102 of the deep end 60 of either groove 43, 51, plus a minimum wall thickness 104 required for structural integrity of the device 1. This represents the absolute minimum thickness 100 for the gear wheel 32, since neither the deep end 60 nor the selected minimum wall thickness 104 can be further reduced. In practice, when the device is constructed of aluminum, this minimum wall thickness 104 has been determined to be approximately 0.030 inches. The drawback of this configuration, however, is that the maximum possible radius 48 of the lower grooves 43 is significantly reduced by having the deep ends 60 of the grooves 43, 51 side-by-side. Reducing the maximum radius 48 in this way inherently reduces the maximum length of the groove 43, which in turn reduces the maximum leverage possible with that groove.

Figure 13:
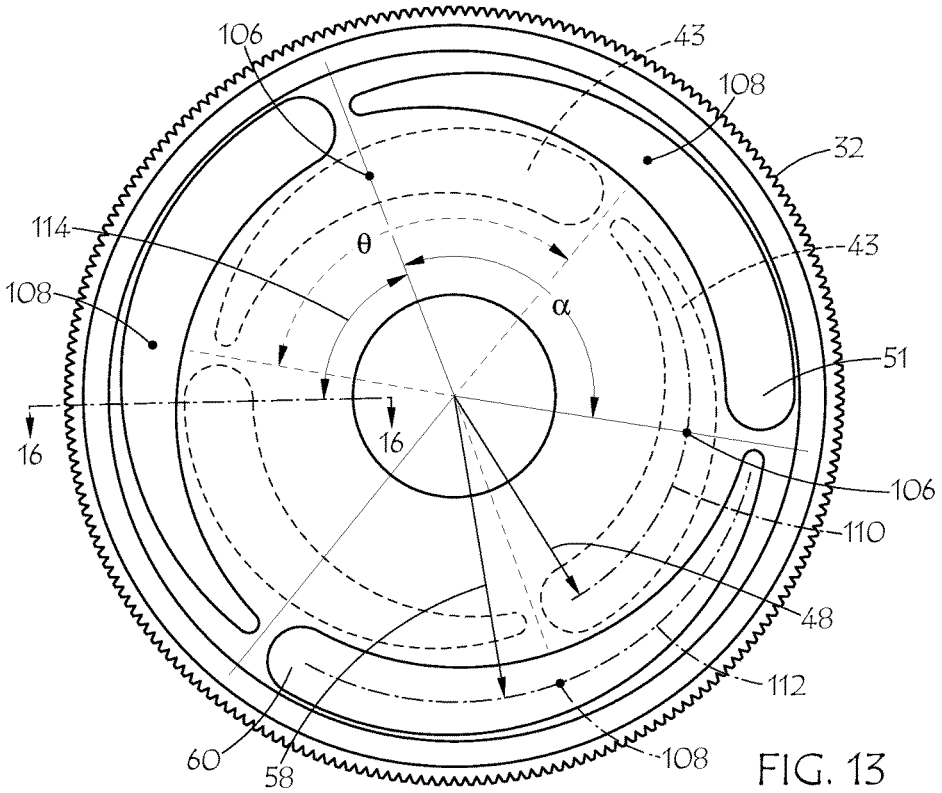
FIG. 13 is a top transparent view of the gear wheel, showing the upper and lower grooves offset from one another.
Figure 16:
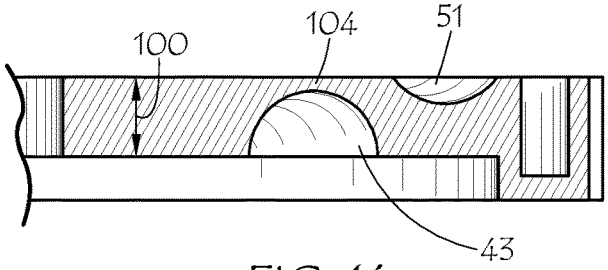
FIG. 16 is a cross-sectional view of the gear wheel shown in FIG. 13.

Referring now to FIGS. 13 and 16, a second configuration of the gear wheel grooves 43, 51 is depicted. The grooves 43, 51 have radial mid-points 106, 108, which are points on the centerline 110, 112 of the respective groove, half-way between the deep end 60 and the shallow end 62 of that groove. In the configuration as shown, the mid-points 106, 108 are radially offset from each other, with the beneficial result that the deep ends 60 of the grooves 43, 51 are no longer positioned side-by-side. Instead, for example, where the grooves 43, 51 are offset by a central offset angle 114 of sixty degrees, the deep end 60 of groove 43 is positioned adjacent to the mid-point 108 of groove 51; and likewise, the deep end 60 of groove 51 is positioned next to the mid-point 106 of groove 43. While sets of three grooves on each surface have been found to be preferred, other numbers of grooves are feasible on each surface. Most generally, the number of grooves in a set may be designated generally as "n," in which case the preferred offset angle would then be equal to 360/2n.

The offset configuration of FIGS. 13 and 16 allows the maximum potential radius 48 of groove 43 to be significantly increased, as compared to the maximum radius allowed by the configuration of FIGS. 12 and 15. Increasing the radius 48 in this way allows groove 43 to be made longer, thereby increasing its leverage without increasing the thickness 100 of the gear wheel 32. While a radial offset angle 114 of sixty degrees provides optimal results, any offset at all will allow an increase in the radius 48. This is due to the fact that the deep ends 60 of grooves 43, 51 would no longer be side-by-side, thereby removing a major limitation on the length of the radius 48.

Figure 17:
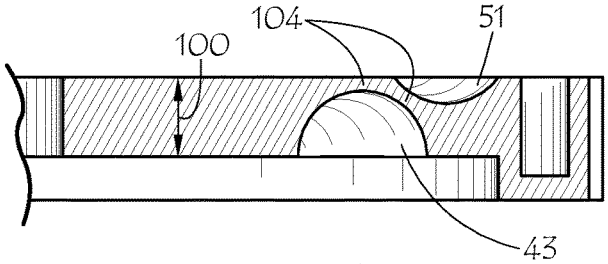
FIG. 17 is a cross-sectional view of the gear wheel shown in FIG. 14.

A third configuration of the grooves 43, 51 may be seen by reference to FIGS. 14 and 17. In this configuration, the grooves 43, 51 are radially offset as previously discussed, preferably with an offset angle 114 of sixty degrees. In addition, the lower grooves 43 have been moved outward on gear wheel 32 from their position in FIGS. 13 and 16. In this position, the upper grooves 51 overlap the lower grooves 43, as best seen in FIG. 17. Moving the grooves 43 further outward in this way increases the radius 48 of the grooves 43, which allows the grooves 43 to be made longer, thereby increasing their leverage without increasing the thickness 100 of the gear wheel 32.

The overlap of the upper grooves 51 over the lower grooves 43 is made possible by the offsetting of the grooves 43, 51 from one another. As best seen in FIG. 15, when the grooves are not offset, they can be placed no closer to one another than shown in FIG. 15, due to the requirement of maintaining a minimum wall thickness 104 between the grooves. As may be seen from the configuration of FIG. 15, when the deep ends 60 of the grooves 43, 51 are side-by-side, there is no room remaining to move groove 43 underneath groove 51 without increasing the thickness 100 of the gear wheel 32. However, as may be seen in FIGS. 13 and 16, offsetting the grooves 43, 51 makes it possible to move the lower grooves 43 under the upper grooves 51, so that the upper grooves 51 overlap the lower grooves 43 as shown in FIG. 17. In this way, offsetting the grooves 43, 51 from one another allows the radius 48 to be increased without increasing the thickness 100 of the gear wheel 32. It is noted that it is a matter of choice as to which of the grooves 43, 51 have a smaller radius 48, 58 in this offset and overlapping configuration. Either selection will produce the desired result, and the upper grooves 51 will overlap the lower grooves 43 in either case.

Figure 10:
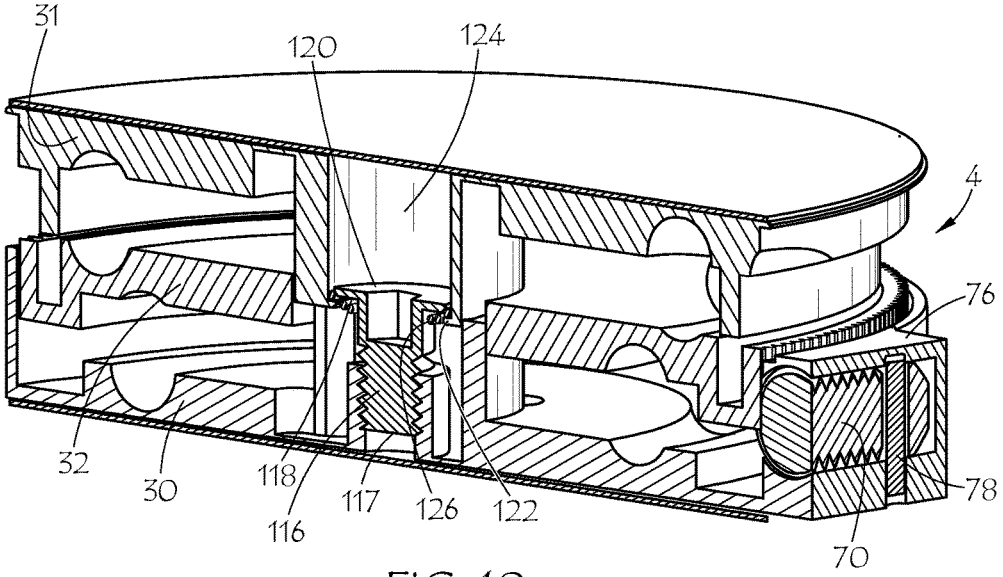
FIG. 10 is a cross-sectional view of the device in the open position.

Referring now to FIGS. 10 and 11, the operation of the optional central retaining bolt 116 is illustrated. When the device 1 is in use, the bolt 116 acts to selectively limit the maximum separation of the disks 30, 31 from the gear wheel 32. This is an important function, because the lifting movement represented by this separation should not be permitted to become so large that the balls 49, 59 travel so far that they are no longer contained within the shallow ends 62 of their respective grooves 42, 43, 51, 52. This limitation on the lifting movement could be accomplished by the user not exceeding the lifting limits of the device, but mechanical limits are more reliable. Thus the lifting movement ideally would be mechanically limited to a preselected maximum, in order to maintain the balls 49, 59 in their respective grooves. This limiting action may be accomplished by the head 120 on the bolt 116, which abuts with flanges 122 on the central retaining bolt sleeve 124 to stop any further separation when the device 1 has reached the fully open position 4. Optional return spring 126 is mounted within the bolt sleeve 124, and is compressed between the head 120 and the flanges 122 as the device 1 is opened, thus adding a return force to aid in closing the device 1. This action is useful when the device 1 is opened, but is not bearing weight, since it is necessary to keep pressure on the balls at all times so that they will roll properly when the device is activated. As will be readily appreciated, no such additional return force is needed when a pool table is already in place on the device.

In practice, a single device under one corner leg of a typical four or six-legged pool table may be sufficient to level the playing surface of the table. This can occur, for example, when just one quadrant of the playing surface is in need of raising in order to satisfactorily level the table. Ideally, however, a system of four jacks is deployed, with one jack under each corner leg of the table. Use of a system of four jacks in this manner ensures that the playing surface may readily be leveled at any time, regardless of the location of any needed lifting or lowering.

One variation of the foregoing system of jacks occurs when one corner of the table is higher than the other corners. Such a situation is typically due to fluctuations in the level of the floor upon which the table rests. When this occurs, a shim or spacer may be placed under the leg at the highest corner, with jacks under the remaining three corner legs.

This invention has been described in detail with reference to particular embodiments thereof, but it will be understood that various other modifications can be effected within the spirit and scope of the invention.

The invention claimed is:

1. A jack comprising:

a circular base disk having an upper surface;

a circular upper disk having a lower surface;

a circular gear wheel disposed between said base disk and upper disk and having a center hole, said gear wheel having a lower surface opposing said base disk upper surface to form a first pair of opposing surfaces, and an upper surface opposing said upper disk lower surface to form a second pair of opposing surfaces, said gear wheel further including gear teeth about the circumference of said gear wheel;

a hub projecting from a first disk of said base disk and upper disk and extending through said center hole of said gear wheel, said gear wheel being rotatably mounted to said hub and being capable of axial motion thereon;

a hub engagement member projecting from a second disk of said base disk and upper disk for engaging said hub to lock said base disk and upper disk rotationally in relation to each other;

a plurality of grooves in said upper surface of said base disk, said grooves following a circular arc along the longitudinal centerline of said base disk grooves, and having a radius extending from the center of said base disk upper surface to said centerline;

a plurality of grooves in said lower surface of said gear wheel, including one groove for each of said base disk grooves, said lower gear wheel surface grooves following a circular arc along the longitudinal centerline of said gear wheel lower surface grooves, and having a radius extending from the center of said gear wheel lower surface to said centerline, said radius being equal to said radius of said base disk upper surface grooves;

a plurality of grooves in said upper surface of said gear wheel, said grooves following a circular arc along the longitudinal centerline of said gear wheel upper surface grooves, and having a radius extending from the center of said gear wheel upper surface to said centerline;

a plurality of grooves in said lower surface of said upper disk, including one groove for each of said upper gear wheel surface grooves, said upper disk grooves following a circular arc along the longitudinal centerline of said upper disk grooves, and having a radius extending from the center of said lower surface of said upper disk to said centerline, said radius being equal to said radius of said gear wheel upper surface grooves;

wherein each said groove in said base disk, said gear wheel and said upper disk has a deep end and a shallow end, and a ramp extending between said ends;

wherein said radius of said gear wheel lower surface grooves and said radius of said gear wheel upper surface grooves are unequal;

wherein each said groove in said base disk, said gear wheel and said upper disk cooperates with an opposing groove in said base disk, said gear wheel or said upper disk to form a first and second opposing pair of grooves wherein the first opposing pair of grooves is between said base disk and said gear wheel and the second opposing pair of said grooves is between said gear wheel and said upper disk; said jack further including:

a ball disposed in each said first and second pair of opposing grooves for rolling movement therein;

a worm gear having threads in geared connection with said gear teeth of said gear wheel; and wherein rotating said worm gear in a selected clockwise or counterclockwise direction causes said gear wheel to rotate in a corresponding selected direction which in turn causes each ball to roll in each first and second pair of opposing grooves and axially move said first and second opposing surfaces either towards each other or away from each other, thereby enabling an axial lowering or lifting movement of said jack.

2. A jack as claimed in claim 1, wherein:

each of said lower gear wheel surface grooves has a first mid-point on the centerline of said lower gear wheel surface groove half way between the deep end and the shallow end of said lower gear wheel surface groove;

wherein each of said upper gear wheel surface grooves has a second mid-point on the centerline of said upper gear wheel surface groove half way between the deep end and the shallow end of said upper gear wheel surface groove; and wherein said first mid-point is radially offset from said second mid-point.

3. A jack as claimed in claim 2, wherein:

each of said upper gear wheel surface grooves overlaps with at least one of said lower gear wheel surface grooves.

4. A jack as claimed in claim 2, wherein:

the number of lower surface gear wheel grooves and the number of upper surface gear wheel grooves are both equal to n; and wherein:

said first mid-point and said second mid-point are offset by an angle equal to 360/2n degrees.

5. A jack as claimed in claim 4, wherein:

each of said upper gear wheel surface grooves overlaps at least one of said lower gear wheel surface grooves.

6. A jack as claimed in claim 4, wherein:

the number n of lower surface gear wheel grooves and upper surface gear wheel grooves is three; and wherein:

said first mid-point and said second mid-point are offset by an angle equal to 60 degrees.

7. A jack as claimed in claim 6, wherein:

each of said upper gear wheel surface grooves overlaps with at least one of said lower gear wheel surface grooves.

8. A jack as claimed in claim 1, further including:

a retaining member for engaging said base disk and said upper disk to prevent further axial lifting movement when said lifting movement reaches a preselected maximum.

9. A jack as claimed in claim 8, wherein:

each of said lower gear wheel surface grooves has a first mid-point on the centerline of said lower gear wheel surface groove half way between the deep end and the shallow end of said lower gear wheel surface groove;

wherein each of said upper gear wheel surface grooves has a second mid-point on the centerline of said upper gear wheel surface groove half way between the deep end and the shallow end of said upper gear wheel surface groove; and wherein said first mid-point is radially offset from said second mid-point.

10. A jack as claimed in claim 9, wherein:

each of said upper gear wheel surface grooves overlaps at least one of said lower gear wheel surface grooves.

11. A method for leveling the playing surface of a pool table having at least three legs, comprising the steps of:

providing at least three jacks for placement under the at least three legs of the pool table to enable the playing surface of the pool table to be leveled and wherein each jack includes:

a circular base disk having an upper surface;

a circular upper disk having a lower surface;

a circular gear wheel disposed between said base disk and upper disk and having a circular center hole, said gear wheel having a lower surface opposing said base disk upper surface to form a first pair of opposing surfaces, and an upper surface opposing said upper disk lower surface to form a second pair of opposing surfaces, said gear wheel further including gear teeth about the circumference of said gear wheel;

a hub projecting from a first disk of said base disk and upper disk and extending through said center hole of said gear wheel, said gear wheel being rotatably mounted to said hub and being capable of axial motion thereon;

a hub engagement member projecting from a second disk of said base disk and upper disk for engaging said hub to lock said disks rotationally in relation to each other;

a plurality of grooves in said upper surface of said base disk, said grooves following a circular arc along the longitudinal centerline of said base disk grooves, and having a radius extending from the center of said base disk upper surface to said centerline;

a plurality of grooves in said lower surface of said gear wheel, including one groove for each of said base disk grooves, said lower gear wheel surface grooves following a circular arc along the longitudinal centerline of said gear wheel lower surface grooves, and having a radius extending from the center of said gear wheel lower surface to said centerline, said radius being equal to said radius of said base disk upper surface grooves;

a plurality of grooves in said upper surface of said gear wheel, said grooves following a circular arc along the longitudinal centerline of said gear wheel upper surface grooves, and having a radius extending from the center of said gear wheel upper surface to said centerline;

a plurality of grooves in said lower surface of said upper disk, including one groove for each of said upper gear wheel surface grooves, said upper disk grooves following a circular arc along the longitudinal centerline of said upper disk grooves, and having a radius extending from the center of said lower surface of said upper disk to said centerline, said radius being equal to said radius of said gear wheel upper surface grooves;

wherein each said groove in said base disk, said gear wheel and said upper disk has a deep end and a shallow end, and a ramp extending between said ends;

wherein each said groove in said base disk, said gear wheel and said upper disk cooperates with an opposing groove in said base disk, said gear wheel or said upper disk to form a first and second opposing pair of grooves wherein the first opposing pair of grooves is between said base disk and said gear wheel and the second opposing pair of said grooves is between said gear wheel and said upper disk; said jack further including:

a ball disposed in each said first and second pair of opposing grooves for rolling movement therein;

a worm gear having threads in geared connection with said gear teeth of said gear wheel;

and including the further step of:

rotating said worm gear in a selected clockwise or counterclockwise direction to cause said gear wheel to rotate in a corresponding selected direction which in turn causes each ball to roll in each first and second pair of opposing grooves and axially move said first and second opposing surfaces either towards each other or away from each other, thereby enabling an axial lowering or lifting movement of each of the said at least three jacks, and wherein a said jack of the said at least three jacks is placed under the at least three legs of the pool table so that the height of each of said at least three legs of the table having one of said jacks of said at least three jacks can be adjusted to level the playing surface of the pool table.

12. The method as claimed in claim 11, wherein each of said jacks further includes:

a retaining member for engaging said base disk and said upper disk to prevent further axial lifting movement when said lifting movement reaches a preselected maximum; and wherein said radius of said gear wheel lower surface grooves and said radius of said gear wheel upper surface grooves are unequal.

13. The method as claimed in claim 12, wherein said retaining member includes:

a central retaining bolt mounted at a proximal end to said base disk, said retaining bolt having a head at a distal end;

a central retaining bolt sleeve extending through said gear wheel and said upper disk; and wherein:

said retaining bolt sleeve has flanges which abut with said head to prevent further axial lifting movement when said lifting movement reaches a preselected maximum.

14. A system for leveling the playing surface of a pool table having at least three legs, comprising:

at least three jacks for placement under the at least three legs of the pool table to enable the playing surface of the pool table to be leveled and wherein each jack includes:

a circular base disk having an upper surface;

a circular upper disk having a lower surface;

a circular gear wheel disposed between said base disk and upper disk and having a center hole, said gear wheel having a lower surface opposing said base disk upper surface to form a first pair of opposing surfaces, and an upper surface opposing said upper disk lower surface to form a second pair of opposing surfaces, said gear wheel further including gear teeth about the circumference of said gear wheel;

a hub projecting from a first disk of said base disk and upper disk and extending through said center hole of said gear wheel, said gear wheel being rotatably mounted to said hub and being capable of axial motion thereon;

a hub engagement member projecting from a second disk of said base disk and upper disk for engaging said hub to lock said base disk and upper disk rotationally in relation to each other;

a plurality of grooves in said upper surface of said base disk, said grooves following a circular arc along the longitudinal centerline of said base disk grooves, and having a radius extending from the center of said base disk upper surface to said centerline;

a plurality of grooves in said lower surface of said gear wheel, including one groove for each of said base disk grooves, said lower gear wheel surface grooves following a circular arc along the longitudinal centerline of said gear wheel lower surface grooves, and having a radius extending from the center of said gear wheel lower surface to said centerline, said radius being equal to said radius of said base disk upper surface grooves;

a plurality of grooves in said upper surface of said gear wheel, said grooves following a circular arc along the longitudinal centerline of said gear wheel upper surface grooves, and having a radius extending from the center of said gear wheel upper surface to said centerline;

a plurality of grooves in said lower surface of said upper disk, including one groove for each of said upper gear wheel surface grooves, said upper disk grooves following a circular arc along the longitudinal centerline of said upper disk grooves, and having a radius extending from the center of said lower surface of said upper disk to said centerline, said radius being equal to said radius of said gear wheel upper surface grooves;

wherein each said groove in said base disk, said gear wheel and said upper disk has a deep end and a shallow end, and a ramp extending between said ends;

wherein each said groove in said base disk, said gear wheel and said upper disk cooperates with an opposing groove in said base disk, said gear wheel or said upper disk to form a first and second opposing pair of grooves wherein the first opposing pair of grooves is between said base disk and said gear wheel and the second opposing pair of said grooves is between said gear wheel and said upper disk; said jack further including:

a ball disposed in each said first and second pair of opposing grooves for rolling movement therein; and, a worm gear having threads in geared connection with said gear teeth of said gear wheel; and wherein rotating said worm gear in a selected clockwise or counterclockwise direction causes said gear wheel to rotate in a corresponding selected direction which in turn causes each ball to roll in each first and second pair of opposing grooves and axially move said first and second opposing surfaces either towards each other or away from each other, thereby enabling an axial lowering or lifting movement of each of the said at least three jacks, and wherein a said jack of the said at least three jacks is placed under the at least three legs of the pool table so that the height of each of said at least three legs of the table having one of said jacks of said at least three jacks can be adjusted to level the playing surface of the pool table.

15. A system as claimed in claim 14 wherein said at least three jacks is at least four said jacks and said at least three legs are at least four legs.

16. A system as claimed in claim 14 wherein a said jack is provided for each leg of the pool table.

17. A system as claimed in claim 14 wherein a leg of the table supports the highest corner of the table and wherein the system further comprises a spacer for placement under the leg of the table which is supporting the highest corner of the table.

18. A system as claimed in claim 14 wherein said radius of said gear wheel lower surface grooves and said radius of said gear wheel upper surface grooves are unequal.

19. A system as claimed in claim 14, further including:

a retaining member for engaging said base disk and said upper disk to prevent further axial lifting movement when said lifting movement reaches a preselected maximum.

20. A system as claimed in claim 19 wherein said radius of said gear wheel lower surface grooves and said radius of said gear wheel upper surface grooves are unequal.

* * * * *